US005078617A

United States Patent [19]

Gutierrez et al.

[11] Patent Number: 5,078,617

[45] Date of Patent: Jan. 7, 1992

[54] PIERCING INSULATION DISPLACEMENT BOARD TERMINAL

[75] Inventors: Mark Gutierrez, Joliet; Timothy R. Ponn, Aurora, both of Ill.

[73] Assignee: Molex Incorporated, Lisle, Ill.

[21] Appl. No.: 647,616

[22] Filed: Jan. 25, 1991

[51] Int. Cl.[5] ..... H01R 4/24

[52] U.S. Cl. ..... 439/422

[58] Field of Search ..... 439/389–425, 439/492–499

[56] References Cited

U.S. PATENT DOCUMENTS 4,106,836 8/1978 Asick et al. ..... 439/422

4,561,714 12/1985 Byczek et al. ..... 439/422

FOREIGN PATENT DOCUMENTS 2081527 2/1982 United Kingdom ..... 439/421

*Primary Examiner*—Joseph H. McGlynn

*Attorney, Agent, or Firm*—Louis A. Hecht; Stephen Z. Weiss; A. A. Tirva

[57] ABSTRACT

An insulation displacement terminal is provided for strain relief termination with a ribbon cable. The terminal includes a forward mating end and a rearward terminating end. The terminating end includes I.D. termination walls having a pair of spaced-apart insulation piercing points and an ID slot therebetween. Support walls are disposed to prevent deformation of the I.D. termination wall. Pairs of insulation piercing strain relief walls are disposed along opposite sides of the terminal. The insulation piercing strain relief walls are dimensioned and configured for crimping engagement with the insulation surrounding a conductor in the ribbon cable.

13 Claims, 2 Drawing Sheets

PIERCING INSULATION DISPLACEMENT BOARD TERMINAL

BACKGROUND OF THE INVENTION

Ribbon cables comprise a planar array of parallel stranded wires imbedded in an integral array of insulation. The insulation is disposed to surround each stranded wire and to integrally fill the webs between adjacent wires. The opposed surfaces of a ribbon cable are characterized by distinct parallel ribs defined by the wires in the insulation. In this regard it should be noted that ribbon cable is a term of art defining a product distinct from flat flexible cable (FFC). FFC generally is much thinner, includes flat conductive strips as opposed to round stranded wire, has thinner insulation and no external ribs. FFC's generally are used in lower current applications and in environment less likely to be subjected to direct pulling forces.

Ribbon cables are terminated to electrical connectors having housings with electrically conductive terminals therein. Each terminal typically is stamped and formed from a unitary piece of metallic material. The terminals are mounted in the housing with a pitch or spacing generally corresponding to the spacing between the stranded wires in the ribbon cable.

It is desirable to automate the termination of cables as much as possible. Insulation displacement terminals are widely employed and are well suited to automated termination processes. The typical prior art insulation displacement terminal includes at least one blade defining an insulation displacement slot. The blade is disposed on the terminal such that the plane of the blade extends transverse to the axis of the wires in the ribbon cable. The wire, and the insulation immediately surrounding the wire, may be urged into the insulation displacement slot, such that the blade pierces through the insulation and electrically contacts the wire in the cable. The dimensions of the insulation displacement slot are selected to achieve a high quality electrical connection with the stranded wire conductor in the ribbon cable.

It is also necessary to ensure that strain relief is achieved between the ribbon cable and the electrical connector. More particularly, the ribbon cables leading to many electrical connectors often are subjected to pulling forces. If the pulling force exerted on the cable is transmitted directly to the insulation displacement portions of the terminal, the quality of the electrical connection can be degraded and/or conductors in the stranded wire of the ribbon cable may be severed.

Strain relief structure has been employed in the prior art to securely affix the insulation of the ribbon cable to a portion of the connector that does not perform a terminating function. For example, some connectors include strain relief structure on the housing for clamping into engagement with the ribbon cable. These structures often require separate costly parts and/or complex molds. Furthermore, these structures generally require separate manual actuation after the termination is completed and after the terminals are inserted into the electrical connector housing. Connectors that employ discrete insulated wires as opposed to ribbon cables often employ arrays of crimpable arms for secure crimped engagement with the insulation on each discrete wire. The crimped engagement of the terminal with the insulation on the wire generally will provide adequate strain relief. Similar strain relief structure is provided on terminals for flat flexible cables. For example, U.S. Pat. No. 4,371,225 issued to Narozny on Feb. 1, 1983 and shows a terminal with pairs of opposed parallel pointed arms for piercing entirely through the insulation and flat conductor of the FFC. The arms are then folded over to simultaneously achieve both electrical termination and strain relief. This teaching for FFC's is not directly applicable to ribbon cables because of the different termination structures required for the round stranded wires of ribbon cables and the likelihood of greater pull-out forces imposed on ribbon cables.

Attempts have been employed to employ the crimped strain in relief teaching of discrete wires or FFC's on ribbon cables. For example, the prior art has prepared the end of the ribbon cable to be terminated by punching, cutting or otherwise removing webs of insulation between adjacent conductors to be terminated. Strain relief crimpable arms may then be passed through the slots in the ribbon cable and crimped into engagement with portions of the insulation surrounding the associated conductor. Connectors employing this prior art technology may perform well, but require a costly and time consuming additional step in the manufacturing process to form the slots adjacent the end of the ribbon cable.

In view of the above, it is an object of the subject invention to provide a terminal for achieving a high quality electrical connection with strain relief to a ribbon cable.

Another object of the subject invention is to provide an insulation displacement terminal for strain relief connection to a ribbon cable.

A further object of the subject invention is to provide an insulation displacement terminal for a ribbon cable with crimpable strain relief structure for piercing the insulation between adjacent conductors of a ribbon cable.

An additional object of the subject invention is to provide an insulation displacement terminal for ribbon cables with support for insulation displacement structure.

SUMMARY OF THE INVENTION

The subject invention is directed to a terminal that is stamped and formed from a unitary piece of metallic material. Preferably, a plurality of the terminals are stamped and formed to be unitary with a carrier strip which enables a large number of the terminals to be reeled on spools for convenient storage and shipment prior to termination. The terminals may be spaced at a convenient distance from one another along the carrier strip in accordance with the amount of metal material required to form the terminals. The carrier strip may subsequently be formed with corrugations or the like to bring the terminals onto the required center-to-center spacing for termination to a ribbon cable. The carrier strip may be severed from the terminals after termination.

Each terminal comprises a forward mating end and a rearward termination end. The forward mating end may be configured appropriately for achieving high quality electrical connection with another terminal during mating. For example, the forward mating end of the terminal may define a pair of converging resilient arms which function as a male terminal for achieving high normal contact forces with an aperture in a printed circuit board or contact beams of a mating female terminal.

The rearward terminating end of the terminal comprises a longitudinally extending base for placement in generally face-to-face relationship with a portion of the ribbon cable insulation surrounding the wire therein. A pair of spaced apart I.D. termination walls are formed to extend substantially orthogonal to the base and substantially orthogonal to the mating axis of the connector. Each I.D. termination wall is substantially planar and includes an I.D. slot extending from a location thereon remote from the base generally orthogonally toward the base. The width of the I.D. slot is dimensioned to be less than the cross-sectional dimension of the stranded wire in the ribbon cable to be terminated. Thus, the strands of wire will rearrange upon insertion into the I.D. slot, and will thereby achieve a large contact area and a high normal contact force with the I.D. termination wall. The entrance to the I.D. slot may be tapered toward the slot and may further be beveled to facilitate the piercing through the insulation of the ribbon cable.

The transverse alignment of the stamped and formed I.D. termination walls makes those walls susceptible to deformation in response to pulling or pushing forces on the ribbon cable and/or forces generated during termination. Such deformation of the I.D. termination wall could degrade the quality of the electrical termination or could prevent complete termination. To prevent deformation of the I.D. termination wall, the terminal comprises support walls extending orthogonal to the base and orthogonally in line with the I.D. termination walls. The support walls are provided in pairs, with the support walls of each such pair being disposed on opposite respective sides of the terminal. Pairs of support walls may be provided both forwardly and rearwardly of each I.D. termination wall. The support walls include sharply beveled edges remote from the base for piercing the insulation web adjacent a wire of the ribbon cable to ensure proper support for the I.D. termination wall during termination and after termination.

The I.D. termination wall and the support wall of the terminal provide some strain relief relative for the cable. However, additional strain relief is required to prevent damage or shifting of the wires disposed within the I.D. slots. Strain relief is provided by the terminal of the subject invention in the form of a plurality of piercing strain relief walls which may be disposed in proximity to the I.D. slot. More particularly, a plurality of pairs of piercing strain relief walls extend orthogonally from the base of the terminal with the strain relief walls in each such pair being on opposite longitudinal sides of the terminal. Edges of each piercing strain relief wall may be bevelled at locations remote from the base of the terminal to facilitate the piercing of the thick webs of insulation of the ribbon cable. The piercing strain relief walls preferably are pointed at locations thereon remote from the base. A plurality of the piercing strain relief walls may define a length sufficient to enable crimping into secure strain relief engagement with portions of the insulation adjacent to the associated wire. These piercing strain relief walls may define lengths in excess of the lengths of the support walls and the I.D. termination walls.

In a preferred embodiment as explained further below, a pair of strain relief walls may be disposed both forwardly and rearwardly of each I.D. termination wall and adjacent at least one pair of support walls. The points of the strain relief walls in each pair may be defined by oppositely angled edges which will lie in substantially adjacent relationship to one another after crimping. A plurality of the terminals may be terminated to a ribbon cable without an initial cable preparation. More particularly, as noted above, the carrier strip on which the terminals are stamped and formed is corrugated or otherwise formed to bring the terminals onto the required center-to-center spacing. The unprepared end of the ribbon cable is then aligned with the rearward terminating end of the array of terminals and is urged downwardly into connection with the terminals. The initial contact of the ribbon cable with the terminals is provided by the longer insulation piercing crimpable strain relief walls which will pass through the insulation defining the webs on opposite respective sides of the particular wire with which the terminal is to be terminated. Further movement of the ribbon cable and terminals toward one another will bring the pointed and bevelled ends of the I.D. termination walls into engagement with the insulation. Deformation of the I.D. termination walls will be prevented by the support walls. Additional movement of the terminals and ribbon cable toward one another will cause the I.D. termination walls to pierce through the insulation and urge the strands of the wires into the I.D. slots. Simultaneously, the shorter support walls will be urged into the insulation web on opposite respective sides of the conductor with which the associated terminal is being terminated. Complete movement of the ribbon cable and terminals toward one another will cause a controlled realignment of the strands of the wire in the I D. slot with correspondingly developed high normal contact forces. Termination is completed by crimping the insulation piercing strain relief walls over the wire in the I.D. slots. These crimped strain relief walls will securely engage portions of the insulation overlying the conductor for achieving the necessary strain relief. Upon completion of termination the carrier strip may be severed from the terminals and the array of terminals on the end of the ribbon cable may be inserted into an electrical connector housing, which may typically be mounted to a board.

DETAILED DESCRIPTION OF THE PREFERRED EMBODIMENT

Figure 1:
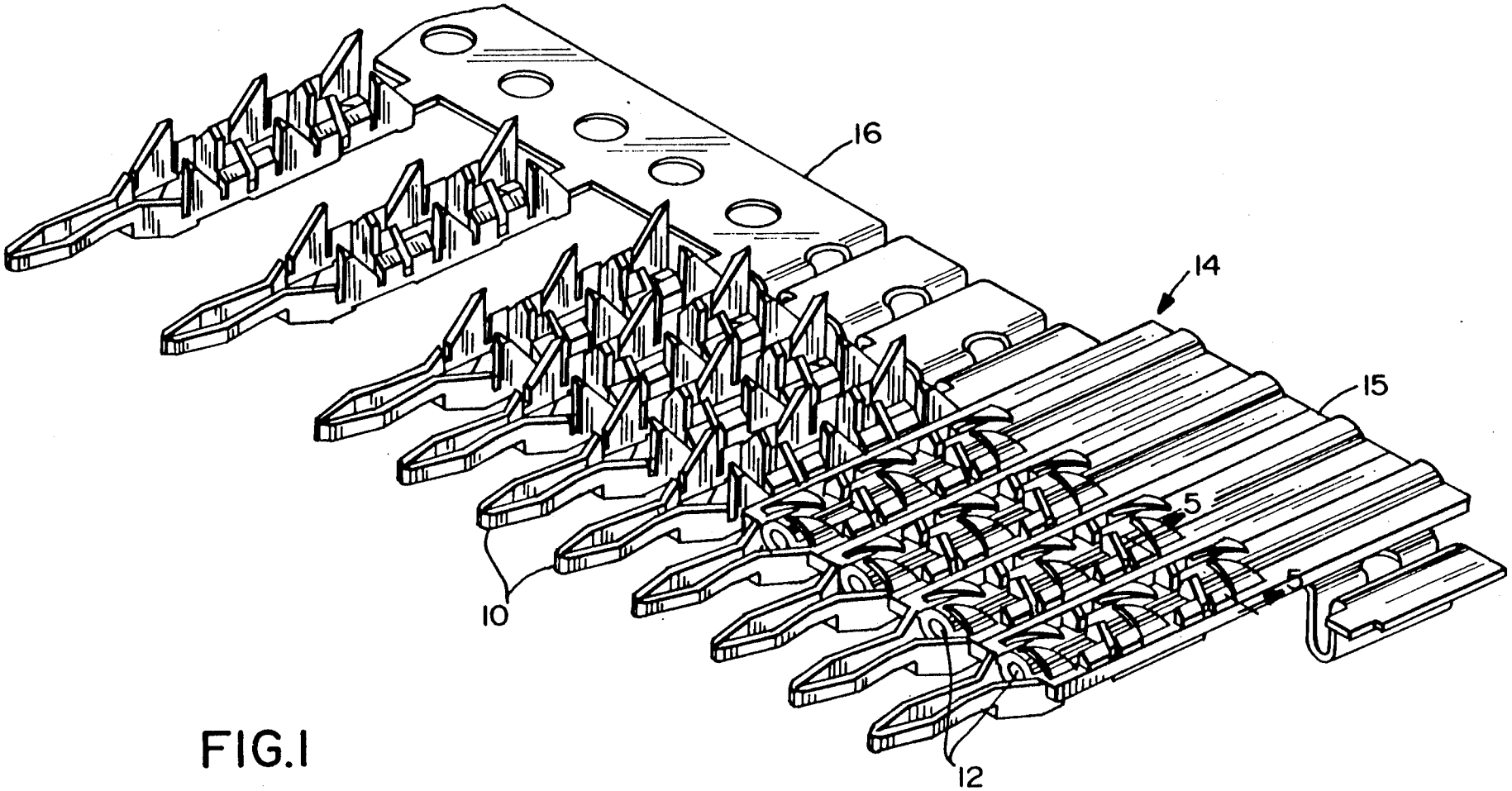
FIG. 1 is a perspective view showing an array of terminals at various sequential stages during termination to a ribbon cable.

A terminal in accordance with the subject invention is identified generally by the numeral 10 in FIGS. 1-5. A plurality of the terminals 10 are intended for termination to the individual stranded wires 12 in a ribbon cable 14. The wires 12 are disposed within an insulation The terminals 10 are of unitary stamped and formed construction, and are initially unitary with a carrier strip 16 as shown in FIG. 1. The carrier strip 16 may initially be generally planar, or may be coiled to enable convenient storage and shipping of the terminals 10 on a spool (not shown). The spacing "a" between the terminals 10 after formation and while stored on a spool will be determined by the amount of metal material required to form each terminal 10, as explained further below. However, the pitch "b" between the terminals after termination to the ribbon cable 14 is less than the initial spacing "a". To achieve this required pitch, the carrier strip 16 is formed or corrugated to bring the terminals 10 into a center-to-center spacing "b" corresponding to the pitch between the conductors 12 of the ribbon cable 14. The terminals 10 may then be terminated to the ribbon cable 14 as explained further below, and after such termination the carrier strip 16 may be separated from the respective terminals 10.

Figure 2:
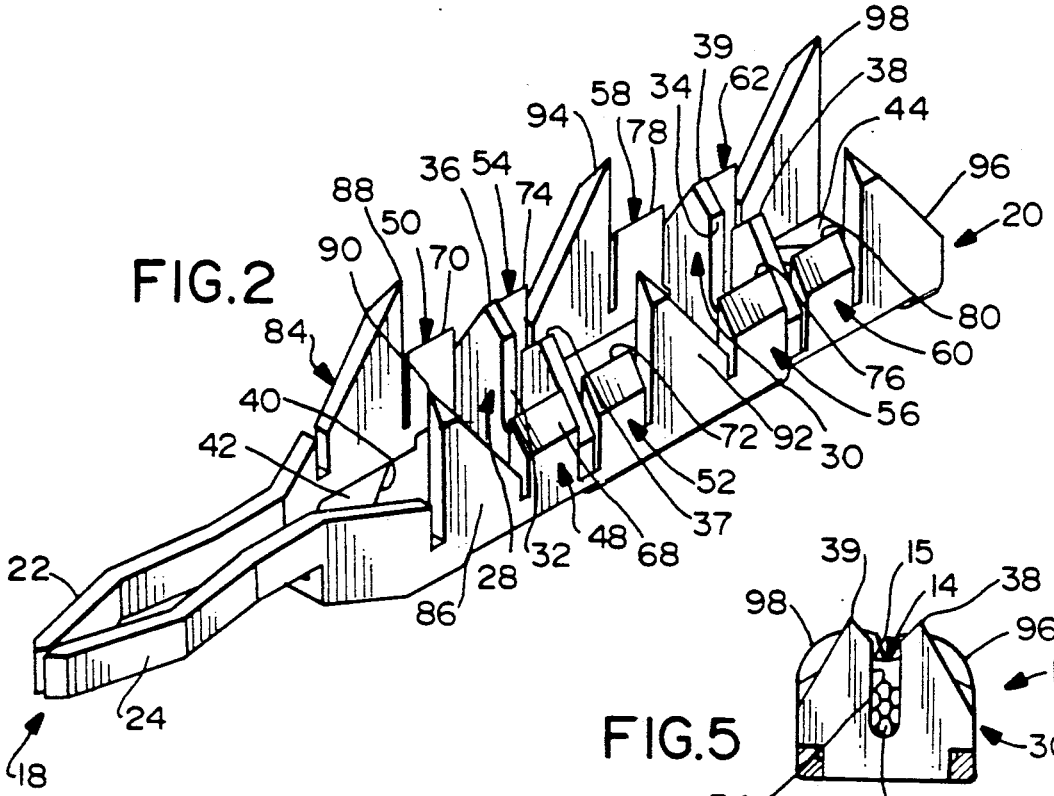
FIG. 2 is a perspective view of a terminal prior to termination and independent of the ribbon cable.
Figure 3:
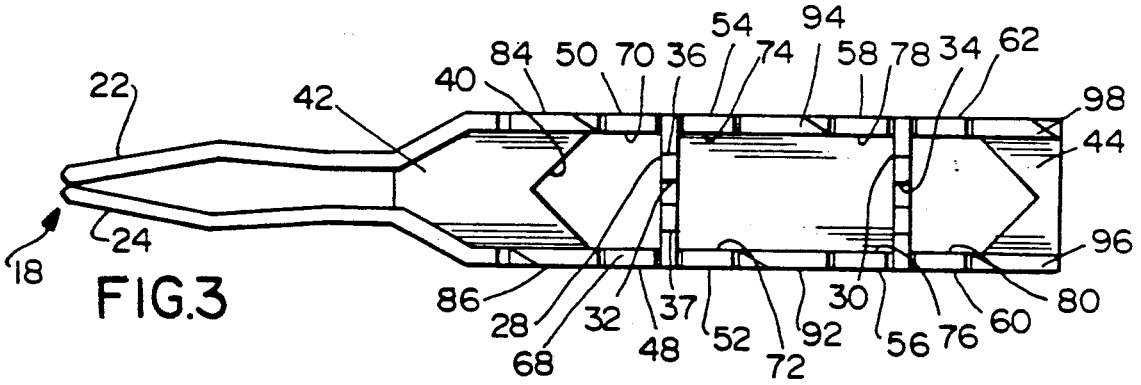
FIG. 3 is a top elevational view of the terminal shown in FIG. 2.
Figure 4:
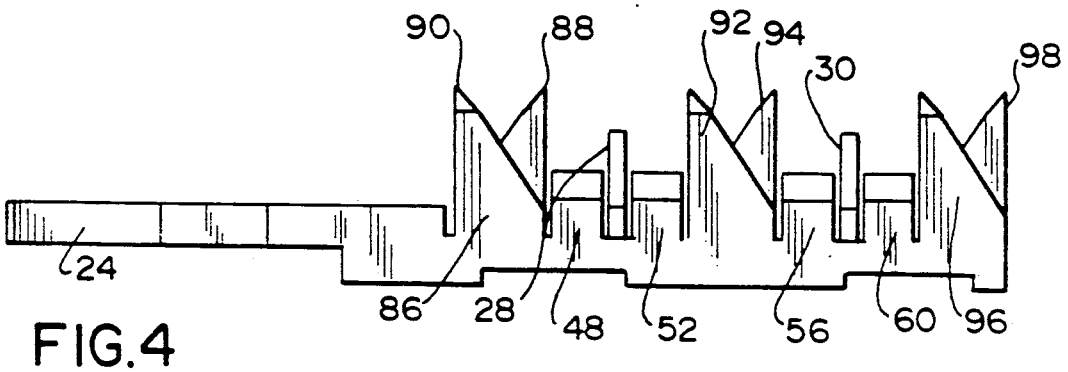
FIG. 4 is a side plan view of the terminal shown in FIGS. 2 and 3.

Turning to FIGS. 2–4, the terminal 10 includes a forward mating end identified generally by the numeral 10 and a rearward terminating end identified generally by the numeral 20. The forward mating end is defined by a pair of resilient generally converging arms 22 and 24 which together define an male end for the terminal 10 which may be mated with a corresponding female terminal.

The rearward terminating end 20 of the terminal 10 is uniquely constructed to provide a high quality electrical termination with the conductors 12 of the ribbon cable 14 shown in FIG. 1, and to achieve exceptional strain relief therewith. More particularly, the rearward terminating end 20 of the terminal 10 is characterized by a generally planar longitudinally extending base 26. Forward and rearward I.D. termination walls 28 and 30 extending generally parallel to one another and orthogonally from the base 26. The I.D. termination walls 28 and 30 are substantially planar and are formed from the plane of the base 26 to be perpendicular to the mating axis of the terminal 10. The I.D. termination walls 28 and 30 include insulation displacement slots 32 and 34 defining a width "c" which is less than the diameter of the stranded wires 12 in the ribbon cable 14 depicted in FIG. 1. Portions of the I.D. termination walls 28 and 30 remote from the base 26 define insulation piercing points 36-39 which are bevelled to enable efficient piercing of the insulation 15 in the ribbon cable 14. It will be noted that the formation of the I.D. termination walls 28 and 30 from the base 26 defines ward I.D. wall 28 and rearwardly of the rearward insulation displacement wall 30. However, as shown most clearly in FIGS. 2 and 3, the base 26 includes continuous portions 42 and 44 at the extreme forward and rearward ends of the terminating portion 20 of the terminal 10 and a continuous base wall 46 between the I.D. termination walls 28 and 30 to ensure adequate strength and rigidity for the terminal 10.

The terminal 10 further defines support walls 48–62 aligned orthogonally to the base 26. More particularly, the support walls 48 and 50 are disposed on opposite respective sides of the terminal 10 immediately forwardly of the I.D. termination wall 28 and in line orthogonally with opposed sides of the I.D. termination wall 28. The support walls 52 and 54 are disposed on opposite respective sides of the terminal 10 immediately rearwardly of the I.D. termination wall 28 and in line orthogonally with opposed sides of the I.D. termination wall 28. The support walls 48–54 thus prevent deformation of the I.D. termination wall 28 from the illustrated alignment orthogonal to the base 26. In a similar manner and for the same purpose, support walls 56 and 58 are disposed on opposed sides of the terminal 10 forwardly of the I.D. termination wall 30, while the support walls 60 and 62 are disposed on opposite sides of the terminal 10, but rearwardly of the I.D. termination wall 30. The support walls 48–62 each include a beveled top edge 68–82 respectively to enable piercing of the insulation 15 in the webs of the ribbon cable 10 during termination. The inward alignment of the bevels 68–82 prevents outward deflection of the support walls 48–62 during termination, and thus ensures proper alignment for supporting the I.D. termination walls 28 and 30.

The terminal 10 further includes crimpable insulation piercing forward strain relief walls 84 and 86 respectively disposed immediately forwardly of the support walls 48 and 50. The forward strain relief walls 84 and 86 each are tapered to sharp bevelled points 88 and 90 respectively for piercing through the insulation in the ribbon cable. The height "d" of the crimpable strain relief walls 84 and 86 exceeds the thickness of the ribbon cable 12 of FIG. 1 with which the terminal 10 is employed. As a result, the strain relief walls 84 and 86 may be crimped into strain relief connection with the insulation of the ribbon cable 14. It will be noted that the crimpable strain relief wall 84 is angled such that the point 88 is at the forwardmost edge thereof. In contrast, the strain relief wall 86 is angled such that the point 90 thereof is at the rearward most edge. With this configuration, the strain relief walls 84 and 86 may be crimped toward one another such that the respective angled edges thereof are generally parallel in the crimped condition with the two crimped strain relief walls 84 and 86 substantially completely overlying the wire 12 embedded within the insulation 15 of the ribbon cable 14.

The terminal 10 further includes a pair of crimpable insulation piercing intermediate strain relief walls 92 and 94 which are substantially identical to the crimpable insulation displacement walls 84 and 86 described above. The crimpable strain relief wall 84 is disposed intermediate the support walls 52 and 56, while the crimpable strain relief wall 86 is disposed intermediate the support walls 54 and 58. In a similar manner, crimpable insulation piercing rearward strain relief walls 96 and 98 extend orthogonally to the base 26 at locations rearwardly of the support walls 60 and 62, and thus define the rearward most end of the terminal 10.

Figure 5:
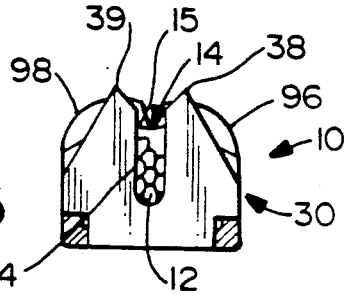
FIG. 5 is a cross sectional view taken along line 5—5 in FIG. 1.

With reference to FIGS. 1 and 5, the ribbon cable 14 is aligned with terminals 10 such that the wires 12 of the ribbon cable 14 are substantially in register with the I.D. slots 32 and 34 in the terminals 10. The ribbon cable 14 and the terminals 10 are then moved toward one another such that the pointed crimpable strain relief walls 84, 86 and 92–98 engage with and pierce through the insulation 15 of the ribbon cable 14 in the webs on opposite respective sides of the associated strand wires 12 therein. Further advancement of the ribbon cable 14 and the terminals 10 toward one another causes the I.D. termination walls 28 and 30 to pierce through the insulation 15 in proximity to the wire 12, such that the wire 12 is urged into the I.D. slots 32 and 34 respectively. Still further advancement of the ribbon cable 14 and the terminals 10 toward one another causes the support walls 48–62 to pierce into and/or through the insulation 15 in the webs on opposite respective sides of the wires 12. After complete seating of the respective terminals 10 relative to the ribbon cable 14, the strands of the wires 12 will be slightly rearranged to achieve a high contact area and high contact forces relative to the I.D. slot 32, 34 in the I.D. termination walls and 30. Additionally, at this stage of the termination, the crimpable strain relief walls 84, 86 and 92–98 may be crimped-over to securely engage the insulation 15 surrounding the respective wires 12 in the ribbon cable 14. As shown most clearly in FIG. 1, the crimped strain relief walls 84, 86 and 92–98 will achieve an interleaved array of strain relief structures tightly engaging the insulation of the ribbon cable 14 and preventing movement of the cable 14 relative to the terminals 10. As a final stage in the termination process, the carrier strip 16 may be separated from the terminals 10, thereby enabling the ribbon cable 14 and the terminals 10 to be inserted into an electrical connector housing, such as a board-mounted housing.

While the invention has been described with respect to a preferred embodiment, it is apparent that various changes can be made without departing from the scope of the invention as defined by the appended claims. For example, other mating end configurations for the terminal may be provided in accordance with the particular needs of the system and the configuration of the terminal to be mated therewith.

We claim:

1. An electrically conductive terminal stamped and formed from a unitary piece of metallic material and comprising a forward mating end and a rearward terminating end for termination with a wire of a ribbon cable, said ribbon cable having insulation surrounding each wire therein and defining webs of insulation between adjacent wires, aid rearward terminating end comprising a longitudinally extending base for disposition against a longitudinally extending surface region of the insulation on the ribbon cable, at least one I.D. termination wall extending orthogonally from the base and defining a pair of spaced-apart insulation piercing points at locations thereon remote from the base and an I.D. slot between the insulation piercing points and extending toward the base for receiving one said wire of the ribbon cable, at least one pair of insulation piercing support walls disposed adjacent said I.D. termination wall for preventing deformation of said I.D. termination wall, a plurality of pairs of insulation piercing strain relief walls extending from opposite longitudinal sides of the base, wherein the strain relief walls, the support walls and the I.,D. wall pierce through the webs joining two adjacent wires of the cable separating the wirers and allowing each wire to enter its respective I.D. slot and allowing straight walls to engage each individual wire.

2. A terminal as in claim 1 wherein the crimpable strain relief walls are formed to define points at locations thereon remote from the base.

3. A terminal as in claim 2 wherein the crimpable strain relief walls are bevelled leading to the point.

4. A terminal as in claim 2 wherein the point on one crimpable wall in each said pair is disposed in a rearward location thereon, and wherein the point on the other crimpable arm in said pair is disposed in a forward location thereon such that the crimpable arms may be crimped toward one another with each said crimpable arm engaging a surface region of the insulation of the ribbon cable.

5. A terminal as in claim 2 comprising a plurality of pairs of crimpable strain relief arms, said pairs of crimpable strain relief arms being spaced from one another along the length of the terminating end of the terminal.

6. A terminal as in claim 1 wherein the support arms are substantially parallel to one another and have bevels at locations thereon remote from the base for piercing through the insulation of the ribbon cable.

7. A terminal as in claim 6 wherein the support walls in each of said pair are on opposite respective sides of the terminal, the bevels converging toward one another at locations remote from the base for preventing outward deformation of the support walls.

8. A terminal as in claim 1 comprising a plurality of I.D. termination walls in spaced parallel relationship to one another.

9. A terminal as in claim 8 comprising forward and rearward pairs of support walls for each of said I.D. termination wall of the terminal.

10. A terminal as in claim 9 comprising a plurality of pairs of crimpable strain relief walls, the pairs of crimpable strain relief walls being disposed such that one pair of crimpable strain relief walls is disposed in proximity to each of said support walls.

11. An electrically conductive terminal for strain relief termination to a wire in a ribbon cable, said ribbon cable comprising insulation surrounding each wire therein and defining webs of insulation between adjacent wires, said terminal comprising a forward mating end and a rearward terminating end, the rearward terminating end comprising a base, a pair of spaced apart parallel I.D. termination walls extending orthogonally from the base each defining a pair of spaced apart insulation piercing points at locations thereon remote from the base, and each defining an I.D. termination walls extending orthogonally from the base each defining a pair of spaced apart insulation piercing points at locations thereon remote from the base, and each defining an I.d. slot therein for displacing the insulation of an individual wire in the cable and engaging the wire thereof, a pair of forward support walls disposed forwardly of each said I.D. termination walls and a pair for rearward support wall disposed rearwardly of each said I.D. termination wall, said support walls being orthogonally aligned with the I.D. termination walls for preventing deformation of said I,.D. termination walls from the respective positions orthogonal to the base, said support walls each comprising insulation piercing means at locations thereon remote from the base, forward and rearward pair of insulation piercing strain relief walls in proximity to the I.D. termination walls, the strain relief walls in each said pair extending from said base a distance remote from the base, wherein eh forward and rear strain relief walls, the forward and rearward support walls and the I.d. termination walls pierce through the webs joining two adjacent wires f the cable separating the wires and allowing each wire to enter its respective I.D. slot.

12. A terminal as in claim 11 further comprising an intermediate pair of insulation piercing strain relief arms disposed intermediate the rearward support walls of the forward I.D. termination wall and the forward support walls of the rearward I.D. termination wall.

13. A terminal as in claim 11 wherein the insulation piercing means of each said support wall defines a bevel at locations thereon remote from the base, the bevels being configured such that the support walls in each said pair taper toward one another at locations further from the base for preventing deformation of the support walls away from one another during termination.

* * * * *